United States Patent [19]

Kobayashi

[11] Patent Number: 4,824,110

[45] Date of Patent: Apr. 25, 1989

[54] GOLF CLUB HEAD

[75] Inventor: Masashi Kobayashi, Matsudo, Japan

[73] Assignee: Maruman Golf, Co., Ltd., Tokyo, Japan

[21] Appl. No.: 19,722

[22] Filed: Feb. 27, 1987

[30] Foreign Application Priority Data

Feb. 28, 1986 [JP] Japan ..... 61-041540

[51] Int. Cl.[4] ..... A63B 53/04

[52] U.S. Cl. ..... 273/78; 273/169

[58] Field of Search ..... 273/169, 171, 167 H, 273/DIG. 8, 167 A, 167 J, 167 F, 78, 172

[56] References Cited

U.S. PATENT DOCUMENTS

| | | | |
|---|---|---|---|
| 2,056,335 | 10/1936 | Wettlaufer | 273/171 X |
| 3,260,525 | 7/1966 | Ortel | 273/171 |
| 3,516,674 | 6/1970 | Scarborough | 273/169 |
| 3,966,210 | 6/1976 | Rozmus | 273/167 J |
| 4,399,992 | 8/1983 | Molitor | 273/DIG. 8 |
| 4,444,395 | 4/1984 | Reiss | 273/171 |
| 4,498,672 | 2/1985 | Bulla | 273/169 |
| 4,687,205 | 8/1987 | Tominaga et al. | 273/169 |

FOREIGN PATENT DOCUMENTS

| | | | |
|---|---|---|---|
| 211781 | 12/1957 | Australia | 273/169 |
| 60-139267 | 7/1985 | Japan . | |
| 61-13984 | 1/1986 | Japan . | |
| 61-22874 | 1/1986 | Japan . | |
| 61-22875 | 1/1986 | Japan . | |
| 727051 | 3/1955 | United Kingdom | 273/169 |

*Primary Examiner*—George J. Marlo

*Attorney, Agent, or Firm*—Armstrong, Nikaido, Marmelstein & Kubovcik

[57] ABSTRACT

A club head of a golf club comprises a head body having a face which is made of a material having high specific elasticity and a weight body made of another material having a specific gravity greater than that of the material of the head body and provided at and covering a substantial portion of a rear portion of the head body, the head body being provided therein with a cavity, the total weight of the weight body being heavier than that of the head body.

10 Claims, 3 Drawing Sheets

GOLF CLUB HEAD

BACKGROUND OF THE INVENTION

1. Field of the Invention

The present invention relates to a golf club, and in particular, to an improved head thereof.

2. Description of the Related Arts

In general, it is desirable to transmit the kinematic energy of a club head to a golf ball at the moment of impact, as effectively as possible, in order to increase the distance of flight of the ball. However, since both the ball and the club head are elastic, especially in a wide sense for the latter, elastic damped oscillation takes place on a club face and a ball surface, in accordance with eigentones thereof. Accordingly, if the eigentones of the face of the club head is lower than that of the ball, the elastic deformation of the ball is restored earlier than the restoration of the elastic deformation of the face of the club head which takes place at the moment of impact, so that the ball undesirably separates too early from the face of the club head. This results in an incomplete transmission of the restoration energy of the face of the club head, which elastically deforms at the moment of impact, to the ball, thus resulting in a loss of an initial velocity of the ball.

Japanese Unexamined Patent Publication (Kokai) No. 60-139267 discloses a golf club head having thereon a face insert having an eigentones substantially identical to that of the ball. However, in the club head disclosed in the publication, the eigentones of the face insert is made identical to that at the ball, an elastic damped oscillation of the face insert takes place under the influence of the eigentones of the remaining portion of the club head which usually has an eigentones frequency lower than that of the face insert.

Generally speaking, the lighter the wieght of a material, the larger the eigentones thereof, and accordingly, it is deirable to concentrically locate the weight portion of the head, as close as possible to a rear portion of the head, so that the face of the head is lighter, in order to minimize the possible influence of the eigentones of the head portion other than the face insert given to the elastic damped oscillation frequency of the face of the head.

However, in the prior art, since the head portion other than the face insert is made of a same material, it is not possible to satisfactorily concentrate the weight distribution of the head in the vicinity of the rear portion thereof.

SUMMARY OF THE INVENTION

The primary object of the present invention is, therefore, to provide a golf club head having a head body which has a sole and a face, and which is made of a light material having a high specific elasticity, said head body being provided, on its rear portion, with a weight body having a specific gravity heavier than that of the head body, said head body being provided therein with a cavity. The specific elasticity referred to herein is a ratio of modulus of elasticity (Young's modulus) relative to the density of the material.

With the above arrangement, the weight portion of the head is concentrically located at the rear portion thereof and the face of the head is lighter, since the weight body is heavier than the head body, which is made of a light material having a high specific elasticity, and is located at the rear portion of the head body, and because the cavity is formed in the head body. As a result of this concentric distribution of the weight, the face of the head has an increased eigentones, so that the elastic damped oscillation frequency of the face of the head is substantially identical to a standard elastic damped oscillation frequency of golf balls at the moment of impact. This results in a sufficient transmission of the restoration energy of the face of the head, which elastically deforms, to a golf ball, thus resulting in an increase in the distance of flight of the ball.

BRIEF DESCRIPTION OF THE DRAWINGS

The invention will be described below in detail with reference to the accompanying drawings, in which.

DESCRIPTION OF THE PREFERRED EMBODIMENTS

Figure 1:
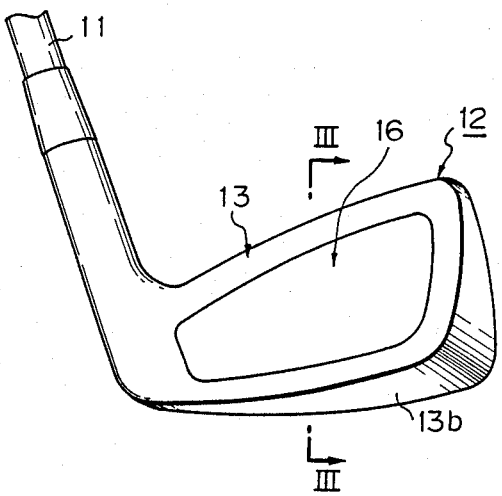
FIG. 1 is a perspective rear view of a club head of an iron club, according to an embodiment of the present invention.
Figure 2:
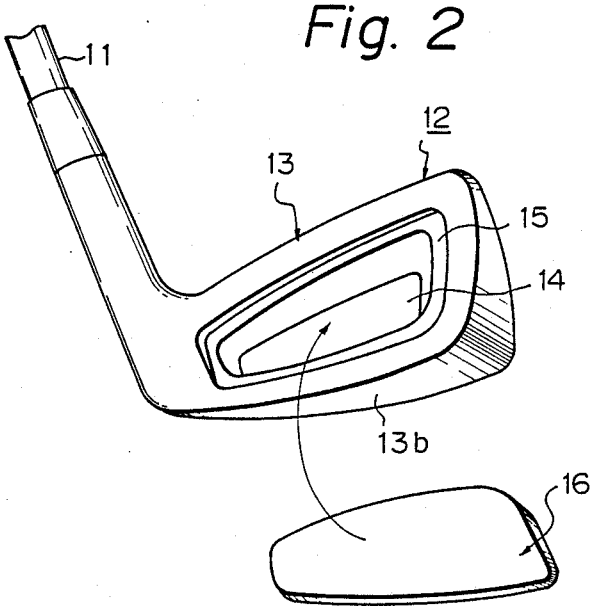
FIG. 2 is an exploded perspective view of a head body and a weight body shown in FIG. 1.
Figure 3:
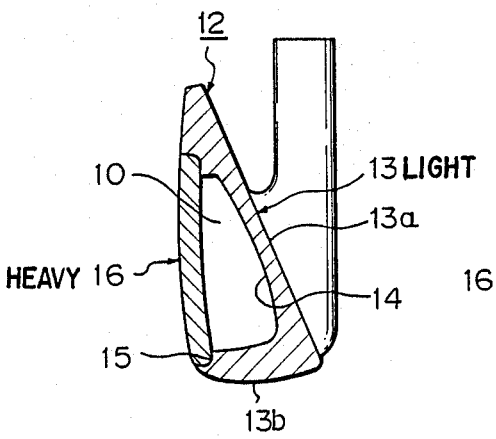
FIG. 3 is a sectional view taken along the line III—III in FIG. 1.

Referring first to FIGS. 1 to 3, which show a first embodiment of the present invention applied to an iron club, a club head 12, which is integrally connected to a lower end of a club shaft 11, has a head body 13 having a face 13*a* and a sole 13*b*. The head body 13 is made of a light material having a high specific elasticity, such as fiber reinforced plastics or a fiber reinforced metal or ceramics.

As can be seen from FIGS. 2 and 3, the head body 13 is provided therein with a recess 14 which opens toward the rear portion of the head body 13. The recess 14 has, at the open end edge thereof, a peripheral spot facing 15. A plate like weight body 16, which is made of a metal having a larger specific gravity than the head body 13, such as stainless steel, titanium, or brass, is located in and on the spot facing 15 and secured to the head body 13 by means of an adhesive or the like.

The weight body 16 covers the recess 14 to define a cavity 10 in the head body 13.

With the construction shown in FIGS. 1 to 3, since the weight body 16, which is heavier than the head body 13 of a light material having a high specific elasticity, is provided on the rear portion of the head body 13, and since the cavity 10 is formed in the head body 13, the weight is concentrically distributed at the rear portion of the club head, and the face side of the head is lighter. This enables the face of the head to have an increased eigentones so as to substantially conform the elastic damped oscillation frequency of the face of the club head to a standard elastic damped oscillation frequency of the golf balls at the moment of impact. As a result, the restoration energy of the face of the club head, which elastically deforms at the moment of impact, can be sufficiently transmitted to the golf ball, thus resulting in an increase in the distance of flight of the golf balls.

Due to the presence of the cavity 10 in the head body 13, the face 13*a* of the head body can easily, elastically, and largely deform at the moment of impact. This results in an increase in the time of contact between the golf ball and the face of the head, thus resulting in an improved control of the direction of flight of the golf ball.

In addition to the foregoing, since the depth of the center of gravity of the club head 12 from the face 13*a* thereof becomes large, due to the presence of the weight body 16 at the rear portion of the head body, a moment of inertia about the center of gravity of the head 12 is increased. This also contributes to an improved control of the direction of flight of a golf ball. Furthermore, since the weight body 16 is located in the rear of the face 13*a* of the head 12, a shock wave applied to the face 13*a* at the moment of impact is effectively reflected by the weight body 16 and acts on a golf ball through the face 13*a*, so that the initial speed of the flight of a golf ball can be increased.

Figure 4:
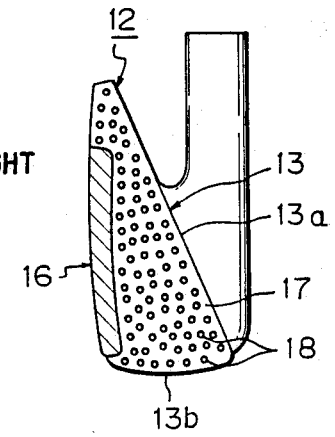
FIG. 4 is a perspective view of a club head of an iron club according to a second embodiment of the present invention.
Figure 5:
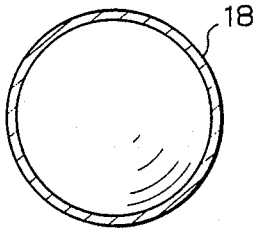
FIG. 5 is an enlarged sectional view of a hollow spherical body used in a club head shown in FIG. 4.

FIGS. 4 and 5 show a second embodiment of the present invention, applied to a club head of an iron club. In FIGS. 4 and 5, the components corresponding to those in the first embodiment illustrated in FIGS. 1 to 3 are designated by the same numerals.

In the second embodiment illustrated in FIGS. 4 and 5, the head body 13, which is made of a light material of high specific elasticity, has a base member 17 and a large number of small hollow spherical bodies 18, dispersed therein. Note, the hollow bodies can be any shape other than spherical. The cavities of the spherical bodies 18 correspond to the cavity 10 in the first embodiment shown in FIGS. 1 to 3. The base member 17 is made of, for example, fiber reinforced plastics, fiber reinforced metal, or ceramics, or the like. The plate like weight body 16, which has a larger specific gravity than the head body 13, can be made of a same material as that of the weight body in the first embodiment. The spherical bodies 18 are preferably made of commercially available hollow glass balls having outer diameters of about 70 $\mu$m.

These glass balls have an apparent specific gravity of $0.15 \sim 0.38$ g/cm$^3$, which is very small, and can be dispersed in the base member 17 with a high distribution density, contributing to a decrease of weight of the head body 13.

In the second embodiment shown in FIGS. 4 and 5, since the weight body 16, which has a heavier specific gravity than the head body 13 which is made of a light material having a high specific elasticity, is provided at the rear portion of the head body 13, and since the cavity consisting of the hollow portions of the small spherical bodies 18 is provided in the head body 13, the same effects as those in the first embodiment can be expected.

Figure 6:
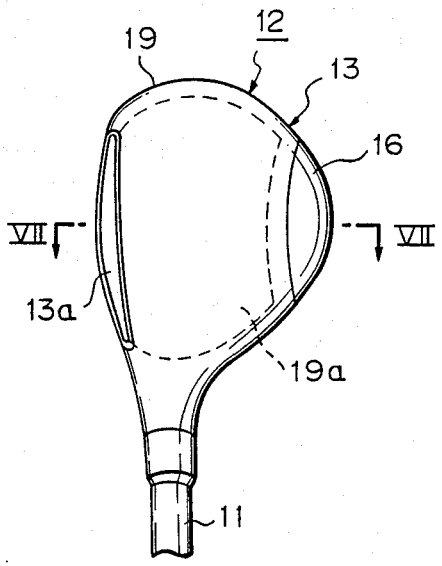
FIG. 6 is a plan view of a club head of a wood club, according to a third embodiment of the present invention; and, FIG. 7 is a sectional view taken along the line VII—VII shown in FIG. 6.
Figure 7:
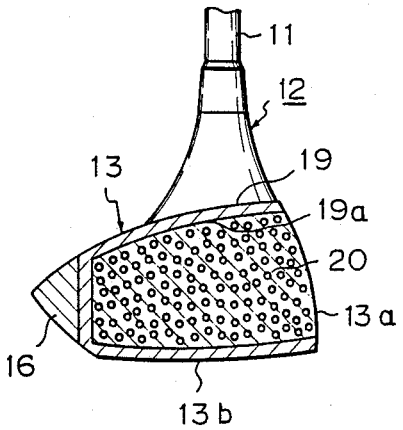

FIGS. 6 and 7 show a third embodiment of the present invention applied to a club head of a wood club. In the third embodiment illustrated in FIGS. 6 and 7, the components of the third embodiment corresponding to those in the first and second embodiments are designated by the same numerals.

In the third embodiment, the head body 13, which is made of a light material having a high specific elasticity, has a base member 19 having a hollow portion 19*a* filled with foamed resin material 20.

The cavity in the third embodiment is formed by foamed inside portions of the foamed resin filler 20. In the third embodiment, the hollow portion 19*a* of the base member 19 opens into the face 13*a* of the head body 13, though not limited thereto, and accordingly, a golf ball can be hit by the face 13*a* formed by the foamed resin filler 20. The base member 19 can be made of, for example, fiber reinforced plastics, fiber reinforced metal, or ceramics or the like. The plate-like weight body 16, having a specific gravity larger than that of the head body 13, can be made of materials similar to those in the previous embodiments. As the foamed resin filler 20, urethane foamed resin, or epoxy foamed resin, or the like can be used. The eigentones of the face of the head 13*a* can be optionally controlled by changing the foaming conditions of the foamed resin of which the foamed resin filler is made.

In the third embodiment, since the weight body 16, which has a heavier specific gravity than the head body 13 which is made of a light material having a high specific elasticity, is provided at the rear portion of the head body, and since the cavity is provided in the head body 13, the same effects as those of the previous embodiments can be expected.

The present invention can be modified or varied by those skilled in the field of the invention without deviating from the scope of protection of the invention.

For example, it is also possible to repalce the hollow portion 19*a* with a closed hollow portion which is sealed by the base member 19, so that the face of the head is formed by the base member rather than the foamed resin filler 20, which is completely enclosed in the closed hollow portion. In this alternative, golf balls are hit by the club face made of the base member in place of the foamed resin filler.

As can be seen from the foregoing description, according to the present invention, since the weight body, which has a heavier specific gravity than the head body which is made of a light material of a high specific elasticity, is provided at the rear portion of the club head body, and since the cavity is provided in the head body, the weight portion can be concentrically located at the rear portion of the head and the head club face can be made lighter. Therefore, it is possible to increase the eigentone of the club face at the moment of impact, in order to make the elastic damped oscillation frequency of the club face substantially coincident with a standard or specific elastic damped oscillation frequency of commonly used or specific golf balls. This enables the restoration energy of the club face of the club head, which elastically deforms at the moment of impact, to be effectively transmitted to a golf ball, resulting in an increase in the distance of flight of the golf ball.

I claim:

1. A club head of a golf club comprising;

a head body having a face which is made of a material having a first specific elasticity and a first specific gravity, said head body being provided therein with at least one cavity, said at least one cavity being located close to said face and extended along substantially the whole surface of said face; and a weight body made of a different material having a second specific gravity greater than said first specific gravity and a second specific elasticity smaller than said first specific elasticity, said weight body being provided at and covering a substantial portion of the rear portion of the said head body such that said at least one cavity remains within said head body, wherein the total weight of said weight body is heavier than that of said head body and the eigentones of said face of said head body is substantially greater than that of said weight body.

2. A club head according to claim 1, wherein said cavity is defined by a recess which is provided in the head body and which opens toward the rear portion of the head body, said recess being closed by the weight body provided at the rear portion of the head body.

3. A club head according to claim 2, wherein said head body is made of a material selected from fiber reinforced plastics, fiber reinforced metal, and ceramics.

4. A club head according to claim 1, wherein said head body comprises a base member and a large member of hollow bodies dispersed in the base member, so that the cavity is formed by the hollow portions of the small hollow bodies.

5. A club head according to claim 4, wherein said small hollow bodies are glass balls having a diameter of about 70 μm.

6. A club head according to claim 4, wherein said base member is made of a material selected from fiber reinforced plastics, fiber reinforced metal, and ceramics.

7. A club head according to claim 1, wherein said head body comprises a hollow base member which is filled with a foamed resin filler, so that the cavity is formed by the foamed inside portions of the foamed resin filler.

8. A club head according to claim 7, wherein said hollow base member opens toward the face of the head, so that the foamed resin filler forms the club face.

9. A club head according to claim 7, wherein said base member is made of a material selected from fiber reinforced plastics, fiber reinforced metal, and ceramics.

10. A club head according to claim 1, wherein said weight body is made of a metal plate.

* * * * *